US007458295B1

(12) United States Patent
Lu et al.

(10) Patent No.: US 7,458,295 B1
(45) Date of Patent: Dec. 2, 2008

(54) INTERCHANGEABLY MANUAL OR AUTOMATIC RATCHET WRENCH TOOL

(75) Inventors: Shi-Tong Lu, Houli Township, Taichung County (TW); Shu-Sui Lin, Taichung (TW)

(73) Assignee: Chen-Hui Wang, Taichung (TW)

( * ) Notice: Subject to any disclaimer, the term of this patent is extended or adjusted under 35 U.S.C. 154(b) by 0 days.

(21) Appl. No.: 11/807,851

(22) Filed: May 29, 2007

(51) Int. Cl.
*B25B 21/00* (2006.01)

(52) U.S. Cl. ..... 81/57.14; 81/57.29; 81/63

(58) Field of Classification Search ..... 81/57.5, 81/57.31, 57.14, 57.43, 57.46, 57.39, 63
See application file for complete search history.

(56) References Cited

U.S. PATENT DOCUMENTS 2,703,030 A * 3/1955 Marvin ..... 81/57.29
2,711,110 A * 6/1955 Brame ..... 81/58.1
2,711,111 A * 6/1955 Brame ..... 81/58.2
2,746,331 A * 5/1956 Andersen ..... 81/58.1
3,016,775 A * 1/1962 Calkins ..... 81/57.13
3,635,654 A * 1/1972 McFarland ..... 405/210
6,205,890 B1 * 3/2001 Roberts et al. ..... 81/63
2004/0093992 A1 * 5/2004 Wojtynek ..... 81/57.3

* cited by examiner

*Primary Examiner*—D. S Meislin
(74) *Attorney, Agent, or Firm*—Pro-Techtor Int'l Services

(57) ABSTRACT

An interchangeably manual or automatic ratchet wrench tool comprises a tool body including a through grove disposed at one end thereof, for receiving a rotating member including peripheral teeth and driven teeth formed therearound, respectively. The tool body further includes a driving piece attached therein and having two engaging tabs mounted thereon for correspondingly engaging with the peripheral teeth of the rotating member, thereby driving the rotating member in a manual operating mode. Moreover, the tool body includes a motor driven by a power source assembly and affixed at another end thereof, the motor includes a worm shaft disposed at one end thereof, for meshing with a worm gear which is rotatably disposed in the tool body, and between the worm gear and the driven teeth of the rotating member is defined with a transmission set for couplingly urging the rotating member in an electric operating mode.

1 Claim, 9 Drawing Sheets

INTERCHANGEABLY MANUAL OR AUTOMATIC RATCHET WRENCH TOOL

BACKGROUND OF THE INVENTION

1. Field of the Invention

The present invention relates to an interchangeably manual or automatic ratchet wrench tool that may easily change its operative modes, such as a manual operation or an electric operation.

2. Description of the Prior Arts

Referring to FIG. 1, a conventional automatic wrench tool includes a stem 20 disposed at one end of a handle 10, at front end thereof mounted a ratchet seat 21, and in the handle 10 defined a motor driven by a power source for driving the elements in the ratchet seat 21 to move. Referring to FIG. 2, a receiving chamber 210 arranged in the middle of the ratchet seat 21 so as to form first and second retaining circles 211 and 212 at two sides thereof. The first retaining circle 211 is provided with a first bore 213 therethrough, yet the second retaining circle 212 is defined with a second bore 214 therethrough. A rotary shank 22, one end of which is coupled to the motor, and another end of which is fixed an eccentric shaft 221, is used for actuating a driving member 222 to rotate. A rotating block 23 is secured a cavity 231 and inner teeth 232 therearound, the cavity 231 is used to receive the driving member 222 so that the eccentric shaft 221 urges the rotating block 23 to cause a reciprocating rotation during the rotation of the rotary shank 22. A control member 24 is provided at one end thereof with an actuation bar 241, and at another end thereof with a direction switch 242 which serves to control the engaging direction of an arresting member 243 and the inner teeth 232 of the rotating block 23 so that the wrench tool can be alternatively rotated in a clockwise or an anticlockwise direction. A spring pad 25 is fitted to the upper end of the control member 24 having the direction switch 242 thereon, and the control member 24 is inserted through the first bore 213 of the first retaining circle 211. The actuation bar 241 is provided at one end thereof with a washer 26, and a C-shaped retainer 27, by which the actuation bar 241 is defined, is retained in a recess 215 around the second bore 214 such that the conventional automatic wrench tool 10 can be assembled. As shown in FIG. 3, while the rotating block 23 is urged to rotate in a clockwise direction by the rotary shank 22, the actuation bar 241 of the control member 24 is driven to rotate because of the engagement of the arresting member 243 and the inner teeth 232, yet as the rotating block 23 idly rotates in an anticlockwise direction, the inner teeth 232 pushes the arresting member 243 to move inwardly, thus having an idle rotation in the anticlockwise direction so as to operate the automatic wrench tool in a clockwise direction repeatedly. It is to be noted that as the idle rotation of the rotating block 23 in an anticlockwise direction, the control member 24 has to be fixed, or a clockwise direction rotation of the rotating block 23 will cause, hence the fastening or unfastening of the workpiece can not be obtained. Because the friction of the spring pad 25 against the inner wall 216 of the first retaining circle 211 and the C-shaped retainer 27 is utilized to fix the control member 24, while the rotating block 23 rotates in an anticlockwise direction, it tightly engages with the arresting member 243, thus the friction is easily overcome so as to urge the actuation bar 241 to rotate. It can be concluded that the friction is an essential factor, but can not interfere the clockwise rotation of the rotating block 23.

Nevertheless, such a conventional automatic wrench tool still has the following defects that could be improved:

1. As the rotary shank 22 driven by the motor urges the eccentric shaft 221 to actuate the repeated swinging of the rotating block 23 in clockwise and anticlockwise directions, by using the engagement of the arresting member 243 and the inner teeth 232, the control member 24 is alternatively driven to move in an engagable actuating and an idle rotatory returning manner, accordingly such an idle rotary returning results in a wastage of the motor power.

2. The motor is easily controlled to cause clockwise and anticlockwise rotations so that the control member 24 is switched to move in different directions, while such a conventional automatic wrench tool applies the direction switch 242 and the arresting member 243 and cooperates with the retaining effect of the inner teeth 232 to achieve the direction-switching purpose, thus a switch complication will happen.

3. The automatic wrench tool is only driven by the motor, so if the shortage of the motor power occurs, it is not allowed to be operated.

The present invention has arisen to mitigate and/or obviate the afore-described disadvantages.

SUMMARY OF THE INVENTION

The primary objective of the present invention is to provide an interchangeably manual or automatic ratchet wrench tool, which comprises a tool body including a through grove disposed at one end thereof, for receiving a rotating member including peripheral teeth and driven teeth formed therearound, respectively. The tool body further includes a driving piece attached therein and having two engaging tabs mounted thereon for correspondingly engaging with the peripheral teeth of the rotating member, thereby driving the rotating member in a manual operating mode.

Another objective of the present invention is to provide an interchangeably manual or automatic ratchet wrench tool, which comprises the tool body including a motor driven by a power source assembly and affixed at another end thereof. The motor further includes a worm shaft disposed at one end thereof, for meshing with a worm gear which is rotatably disposed in the tool body, and between the worm gear and the driven teeth of the rotating member is defined with a transmission set for couplingly urging the rotating member in an electric operating mode.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
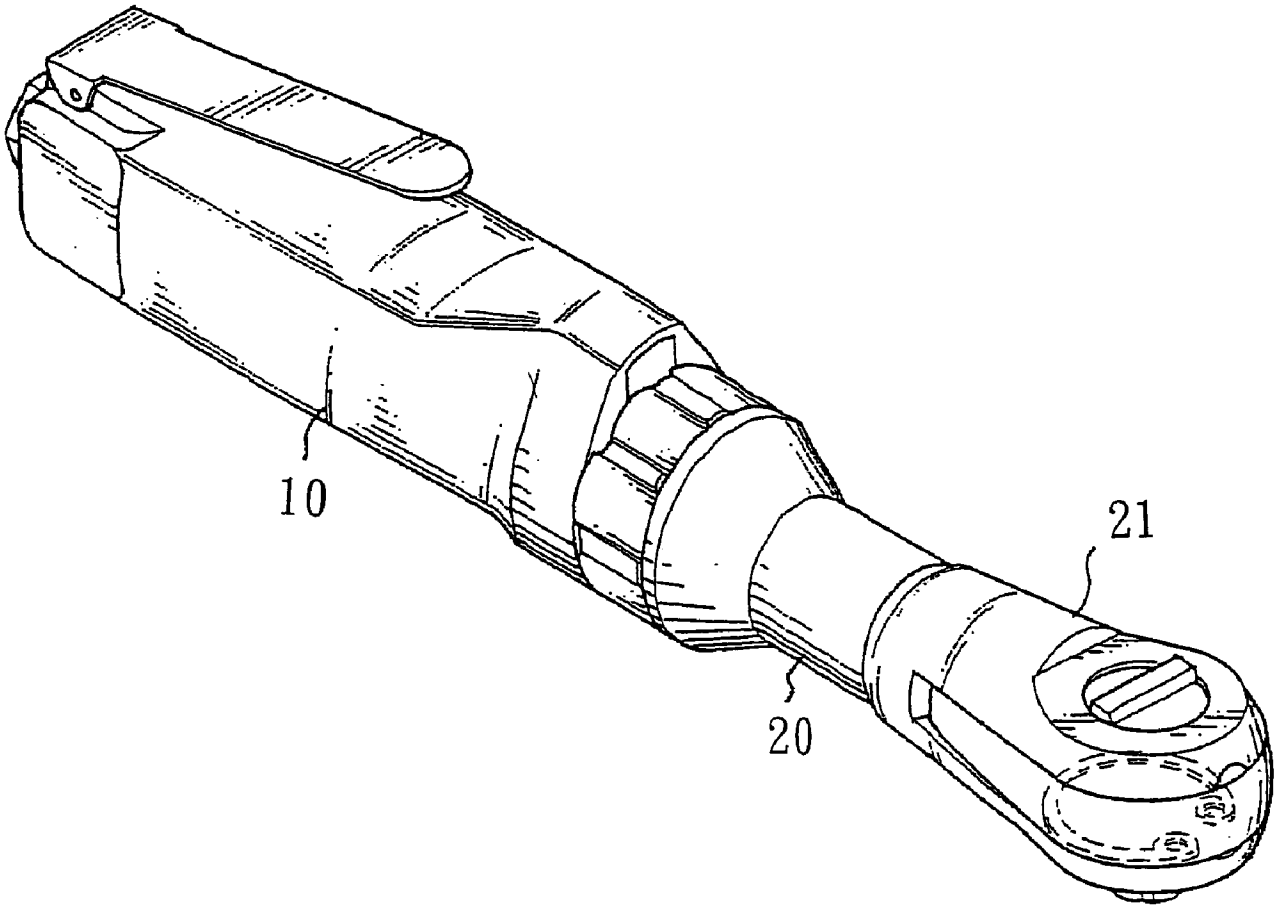
FIG. 1 PRIOR ART
FIG. 1 is a perspective view of a conventional automatic wrench tool.
Figure 2:
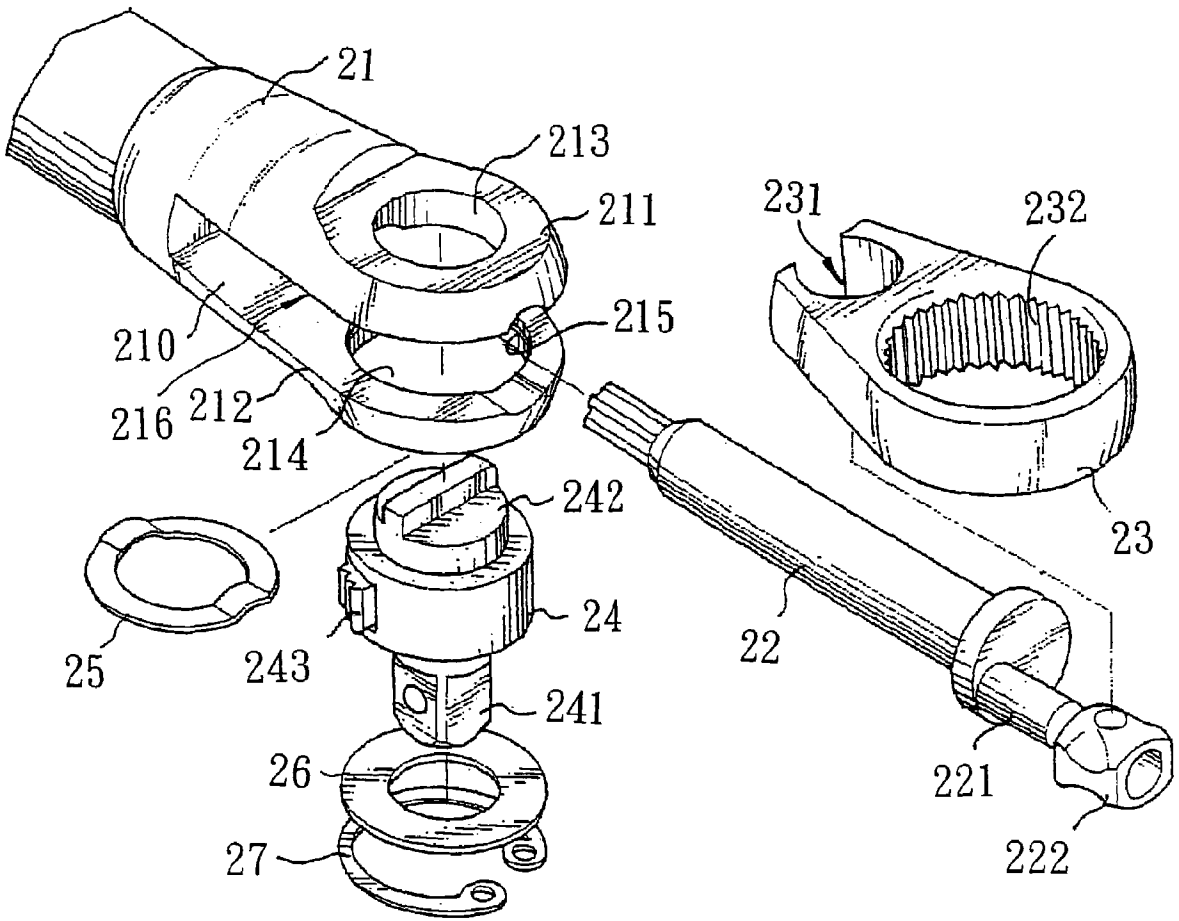
FIG. 2 PRIOR ART
FIG. 2 is an exploded view of the conventional automatic wrench tool.
Figure 3:
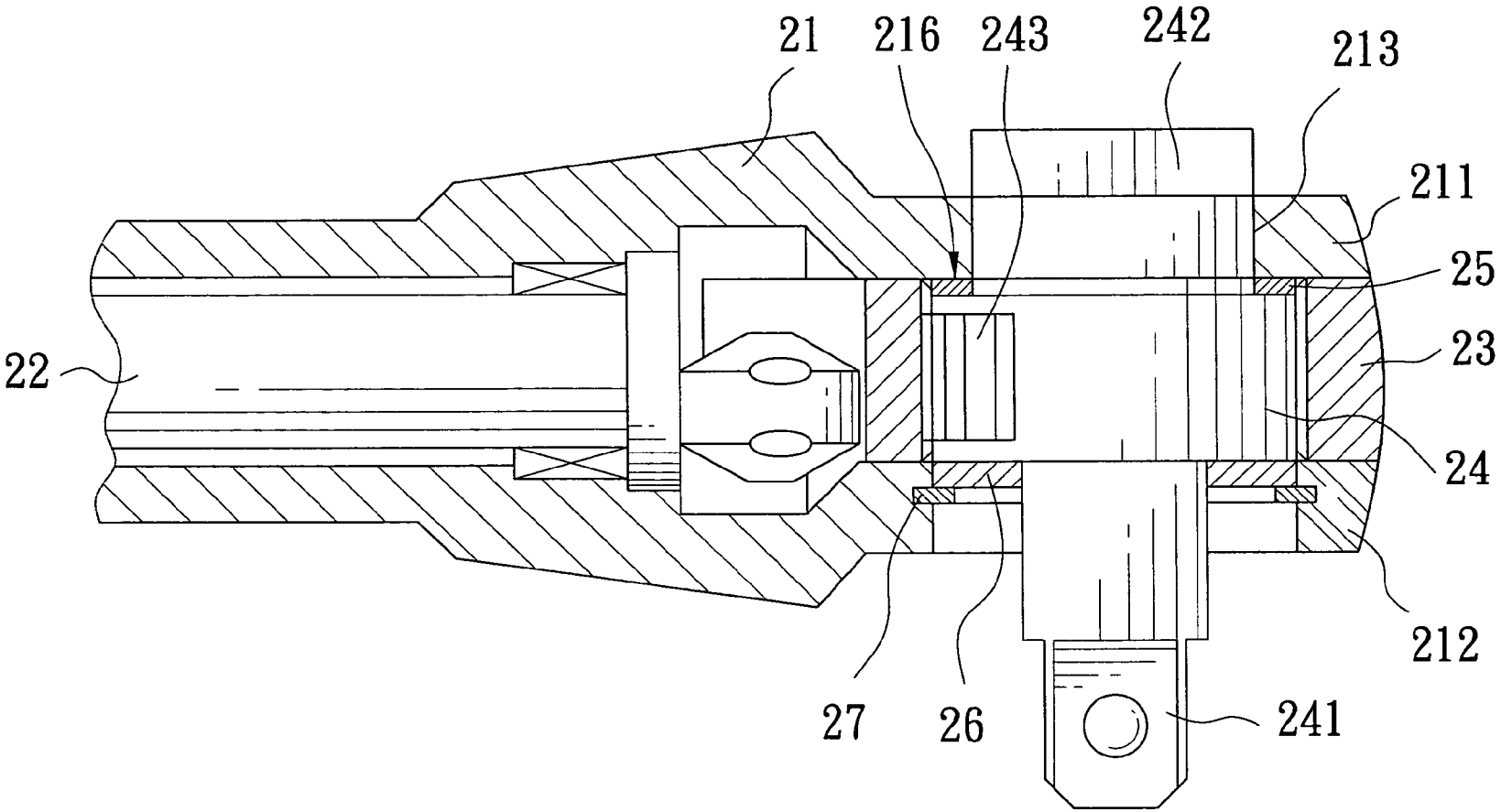
FIG. 3 PRIOR ART
FIG. 3 is a partial assembly cross sectional view of the conventional automatic wrench tool.
Figure 4:
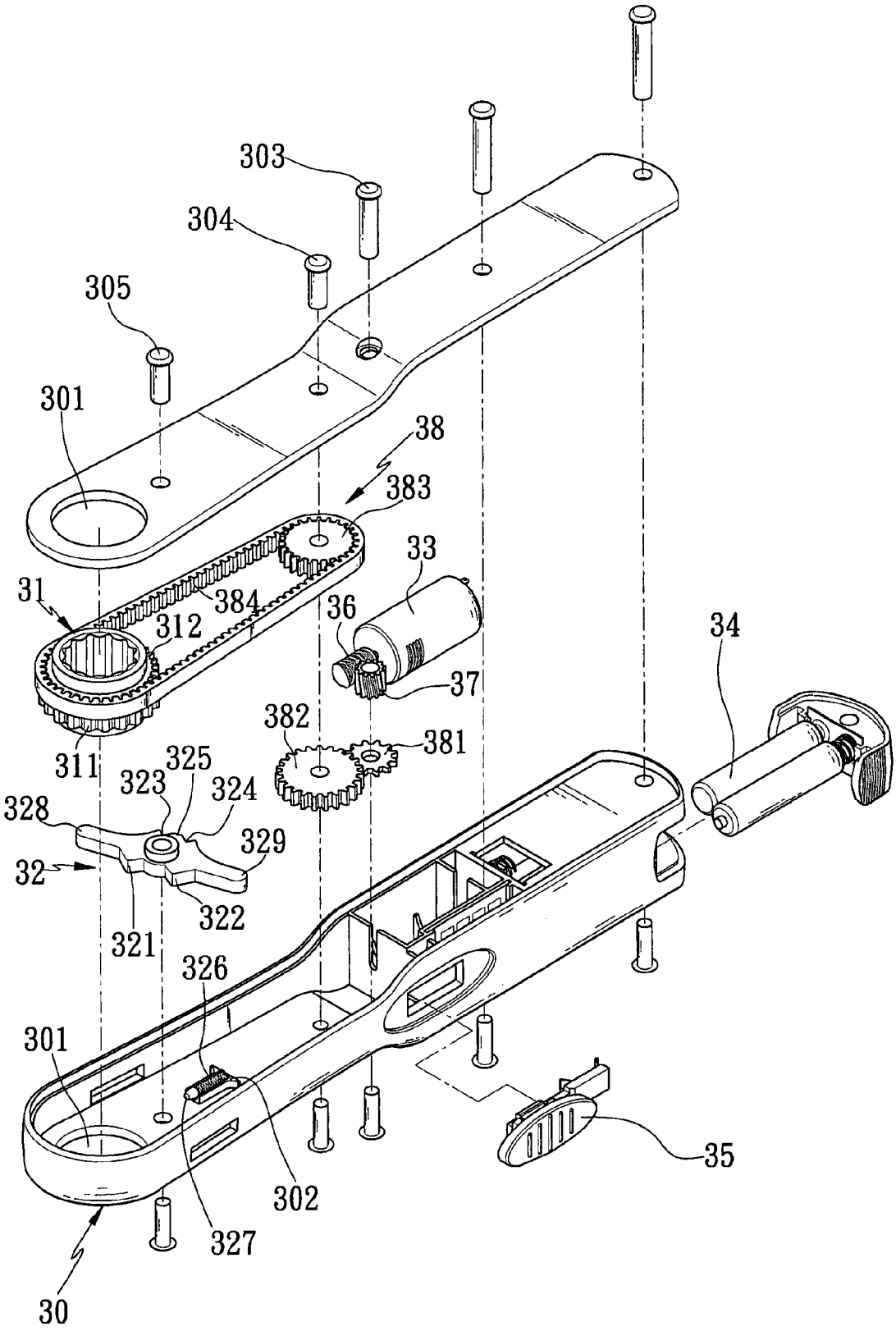
FIG. 4 is an exploded view of an interchangeably manual or automatic ratchet wrench tool of the present invention.
Figure 5:
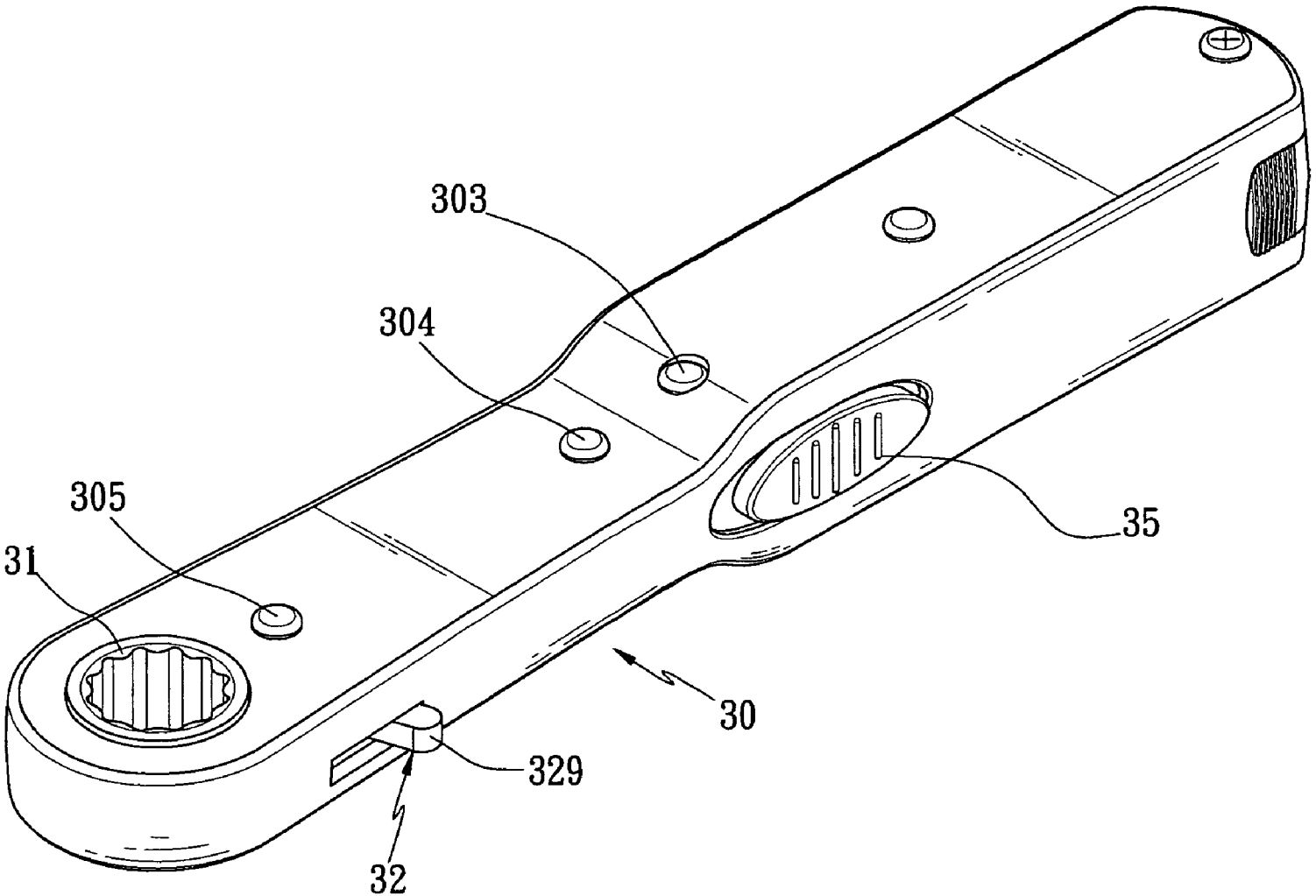
FIG. 5 is a perspective view of the interchangeably manual or automatic ratchet wrench tool of the present invention.
Figure 6:
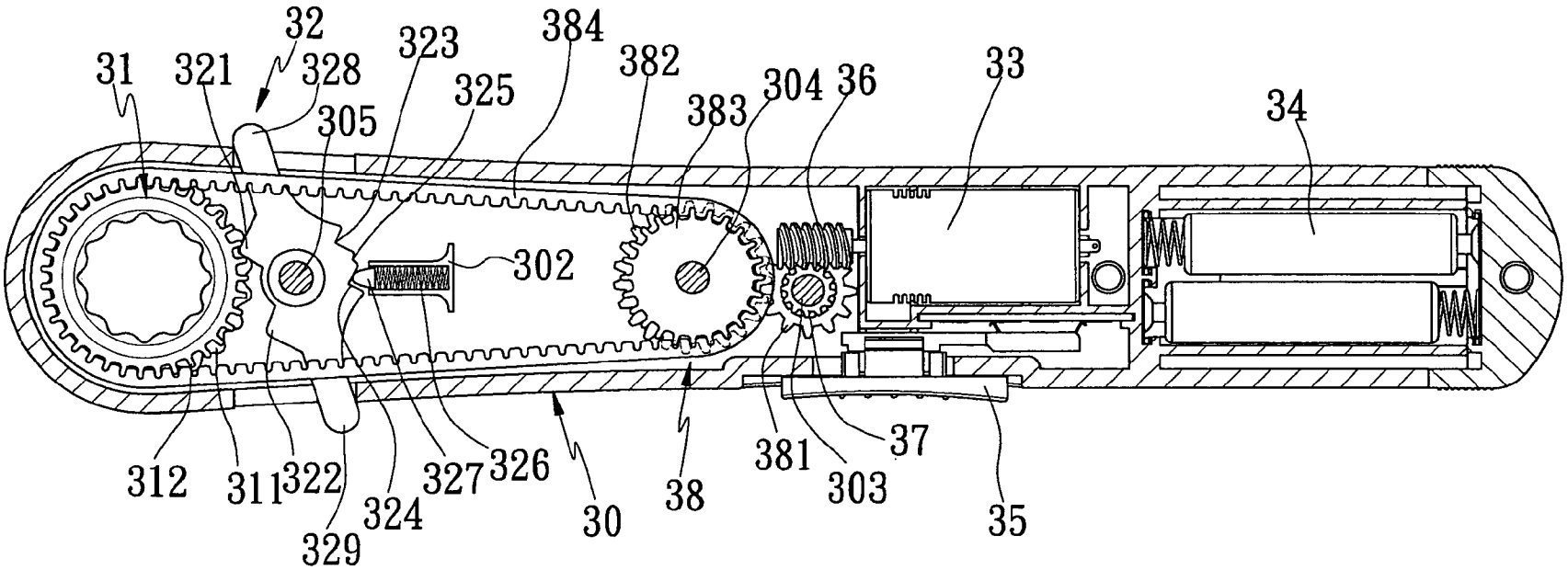
FIG. 6 is an assembly cross sectional view of the interchangeably manual or automatic ratchet wrench tool of the present invention.

Referring to FIGS. 4-6, an interchangeably manual or automatic ratchet wrench tool according to the present invention comprises a tool body 30 including a through groove 301 provided at one end thereof for receiving a rotating member 31 having peripheral teeth 311 and driven teeth 312 both formed therearound, and including a driving piece 32 rotatably affixed therein by a pivot element 305. The driving piece 32 includes actuation portions 328 and 329 extended out of the tool body 30, includes first and second engaging tabs 321, 322 disposed at one side thereof for corresponding engagement with the peripheral teeth 311 of the rotating member 31, and includes first, second and third engaging recesses 323, 324 and 325 attached on another side thereof. Besides, the tool body 30 also includes a receiving block 302 extendedly mounted in a predetermined place therein, for receiving a spring 326 and a detent 327 therein such that as the detent 327 is biased by the spring 326, it may correspondingly press against one of the first, second and third engaging recesses 323, 324 and 325, wherein the second engaging tab 322 of the driving piece 32 may resiliently engage with the peripheral teeth 311 of the rotating member 31 as the detent 327 contacts with the first engaging recess 323, the first engaging tab 321 of the driving piece 32 may resiliently engage with the peripheral teeth 311 of the rotating member 31 as the detent 327 is in contact with the second engaging recess 324, yet the first and second engaging tabs 321 and 322 of the driving piece 32 may disengage from the peripheral teeth 311 of the rotating member 31 as the detent 327 overlies the third engaging recess 325. The tool body 30 further contains a motor 33 disposed therein and a power source assembly 34 defined at another end thereof for driving the motor 33, and includes a switch 35 attached on one side wall thereof for electrical connection with the motor 33 and the power source assembly 34, thereby controllably turning on/off and rotating the motor 33. The motor 33 includes a worm shaft 36 fixed thereon and meshing with a worm gear 37, which is rotatably disposed in the tool body 30 by a first bolt element 303, and during the rotation of the motor 33, the worm gear 37 may be driven to rotate by the worm shaft 36. A transmission set 38, which is couplingly affixed between the worm shaft 36 and the driven teeth 312 of the rotating member 31, includes a first transmitting gear 381 also rotatably mounted in the tool body 30 by the first bolt element 303 and may simultaneously rotate and share the common axis with the worm gear 37 so that the worm shaft 36 urges the rotation of the worm gear 37, and the first transmitting gear 381 turns with the worm gear 37. Furthermore, a second bolt element 304 is used to pivotally dispose a second transmitting gear 382 and a pulley 383 which may cause a simultaneous rotation with each other. The first transmitting gear 381 engages with the second transmitting gear 382 for driving the second transmitting gear 382 to rotate during its rotation, thus rotating the pulley 383, any by using a belt 384 to engageably connect the pulley 383 and the driven teeth 312 of the rotating member 31, it may transmit the power to the driven teeth 312 for rotatably urging the rotating member 31 during its rotation.

Figure 7:
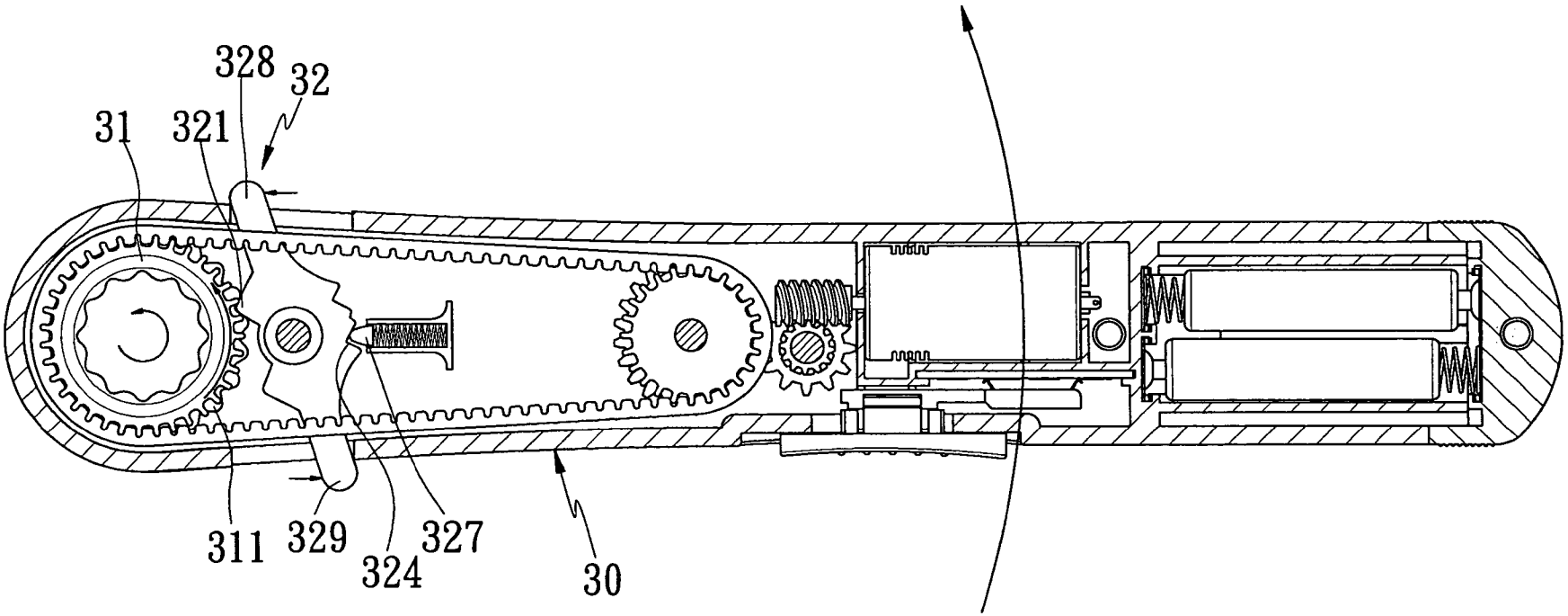
FIG. 7 is a first operational sectional view illustrating the manual operating mode of the present invention.
Figure 8:
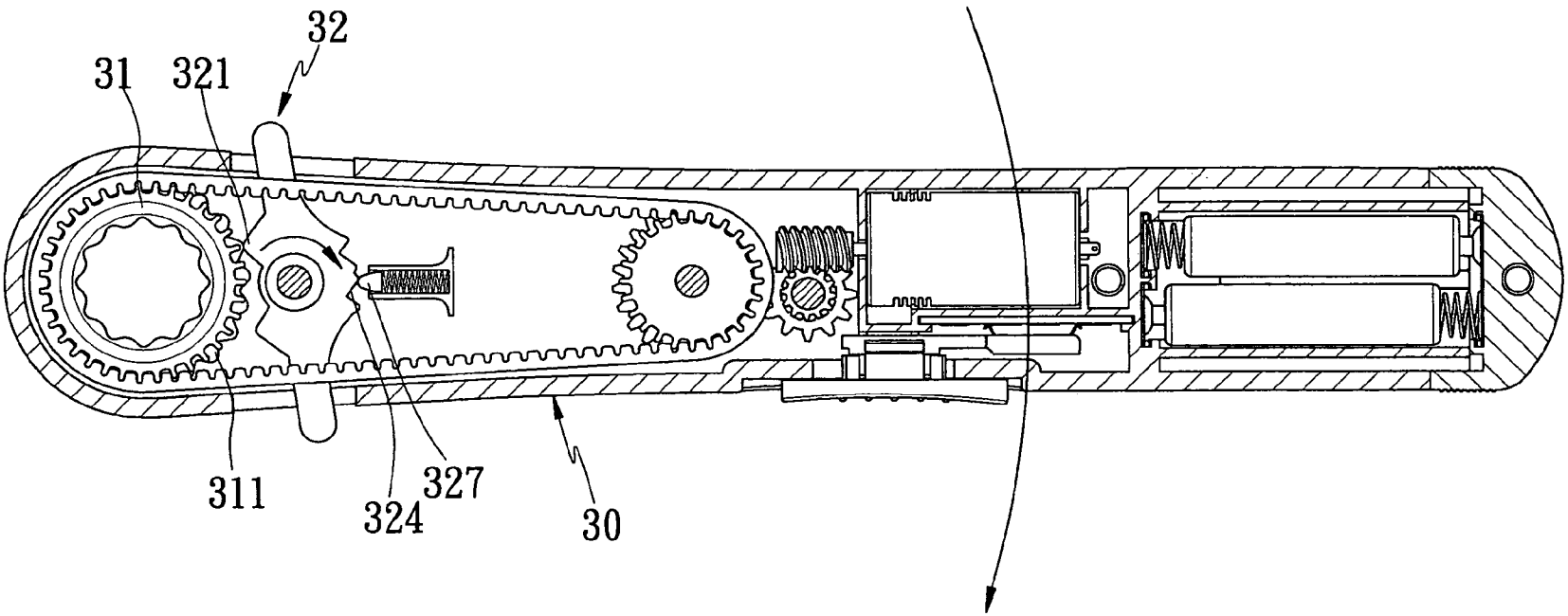
FIG. 8 is a second operational sectional view illustrating the manual operating mode of the present invention.

As shown in FIG. 7, in a manual operating mode, for example, as loosening workpieces, the driving piece 32 is turned in an counterclockwise direction to resiliently engage the peripheral teeth 311 of the rotating member 31 by means of the first engaging tab 321 thereof, and then by wrenching the tool body 30, the first engaging tab 321 of the driving piece 32 engagably urges the peripheral teeth 311 to turn the rotating member 31. Referring to FIG. 8, during the rotation of the tool body 30 in a clockwise direction, the detent 327 resiliently acts against the second engaging recess 324 of the driving piece 32 so that the peripheral teeth 311 of the rotating member 31 may adversely press against the first engaging tab 321 to rotate inward, thereby idly rotating the tool body 30 in a clockwise direction to return for repeatedly loosening workpieces in a manual operating manner.

Figure 9:
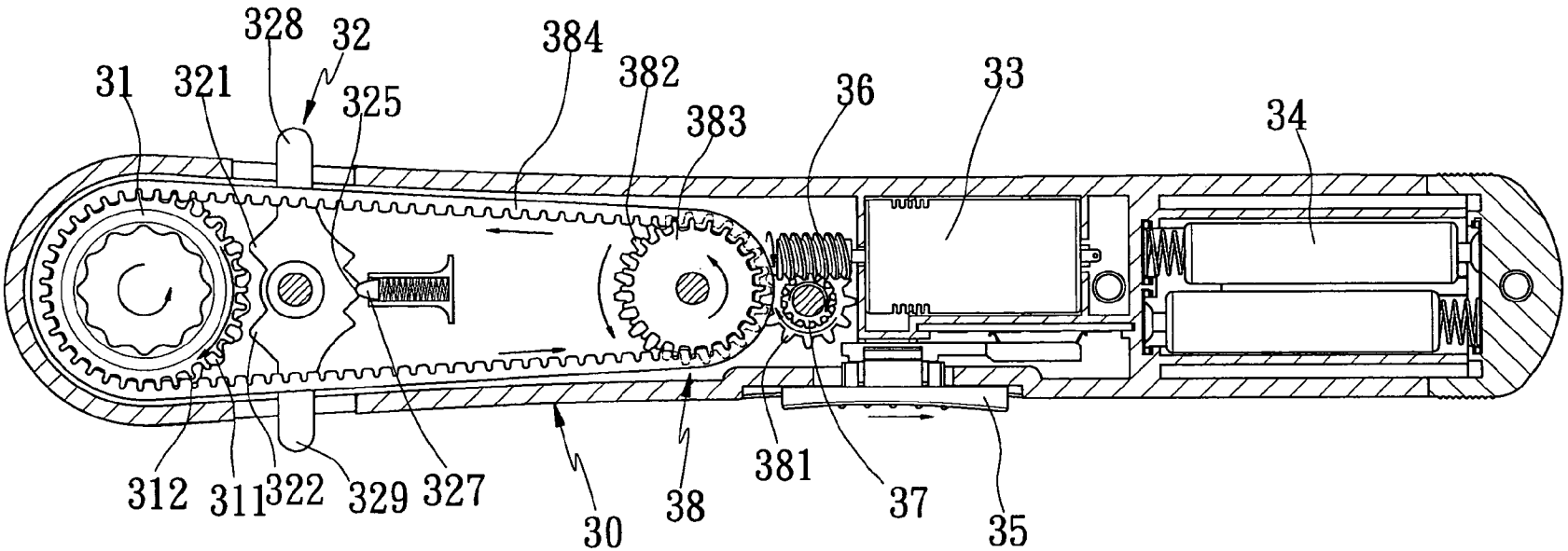
FIG. 9 is an operational sectional view illustrating the electric operating mode of the present invention.

As illustrated in FIG. 9, in an electric operating mode, the actuation portions 328 and 329 are rotated to make the driving piece 32 locate at the central position so that the first and second engaging tabs 321, 322 both disengage from the peripheral teeth 311 of the rotating member 31. In the meantime, the switch 35 may be controllably turned on to cause the clockwise or counterclockwise rotation of the motor 33 so as to have an electric connection with the power source assembly 34. Taking loosening workpieces as an example, during the rotation of the motor 33, the worm shaft 36 drives the rotation of the worm gear 37, and the first transmitting gear 381, which may simultaneously rotate with the worm gear 37, urges the second transmitting gear 382 to rotate, and the pulley 38, which may rotate with the second transmitting gear 382, simultaneously rotates. Thereafter, by virtue of the belt 384, the power of the pulley 383 may be transmitted to the driven teeth 312 of the rotating member 31 for urging the rotation of the rotating member 31, thereby obtaining an electrically operative purpose.

While we have shown and described various embodiments in accordance with the present invention, it should be clear to those skilled in the art that further embodiments may be made without departing from the scope of the present invention.

What is claimed is:

1. An interchangeably manual or automatic ratchet wrench tool comprising a tool body including a rotating member having peripheral teeth and driven teeth formed therearound, respectively, including a driving piece attached therein and having engaging tabs mounted thereon for correspondingly engaging with said peripheral teeth of said rotating member, thereby driving the rotating member, said tool body further including a motor driven by a power source assembly and affixed at another end thereof, said motor including a worm shaft disposed at one end thereof, for meshing with a worm gear which is rotatably disposed in said tool body by a first bolt element, and between said worm gear and said driven teeth of said rotating member being defined with a transmission set for couplingly urging said rotating member;

wherein said tool body includes a through groove provided at one end thereof for receiving said rotating member;

further comprising said tool body including a receiving block extendedly mounted therein, for receiving a spring and a detent, and said driving piece including first, second and third engaging recesses attached on another side thereof so that a detent correspondingly presses against one of said first, second and third engaging recesses;

wherein said driving piece includes actuation portions extended out of said tool body;

wherein said motor is controllably turned on/off and rotated in a clockwise direction or a counterclockwise direction by a switch; and wherein a transmission set includes a first transmitting gear also rotatably mounted in said tool body by said first bolt element and simultaneously rotates with said worm gear, furthermore, a second bolt element is used to pivotally dispose a second transmitting gear and a pulley which causes a simultaneous rotation with each other, and said first transmitting gear engages with said second transmitting gear, and said pulley is engageably connected with said driven teeth of said rotating member by a belt.

* * * * *